US008632066B2

(12) United States Patent
Nakamura et al.

(10) Patent No.: US 8,632,066 B2
(45) Date of Patent: Jan. 21, 2014

(54) PAPER SHEET CASSETTE AND IMAGE FORMING DEVICE

(75) Inventors: Yasuo Nakamura, Toyokawa (JP); Naoichi Asakura, Shinshiro (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/108,054

(22) Filed: May 16, 2011

(65) Prior Publication Data

US 2011/0285075 A1 Nov. 24, 2011

(30) Foreign Application Priority Data

May 18, 2010 (JP) ..... 2010-113864

(51) Int. Cl.
*B65H 1/00* (2006.01)

(52) U.S. Cl.
USPC ..... 271/171

(58) Field of Classification Search
USPC ..... 271/145, 171, 248; 399/393
See application file for complete search history.

(56) References Cited

U.S. PATENT DOCUMENTS

| | | | | |
|---|---|---|---|---|
| 5,713,570 | A * | 2/1998 | Ouchi | 271/242 |
| 7,845,632 | B2 * | 12/2010 | Windsor et al. | 271/171 |
| 8,087,664 | B2 * | 1/2012 | Imai | 271/171 |
| 8,286,962 | B2 * | 10/2012 | Tanaka | 271/171 |
| 2005/0062218 | A1 * | 3/2005 | Murakami et al. | 271/171 |
| 2007/0114713 | A1 * | 5/2007 | Yonemoto | 271/171 |
| 2010/0148427 | A1 * | 6/2010 | Shimazu et al. | 271/171 |

FOREIGN PATENT DOCUMENTS

| | | | | |
|---|---|---|---|---|
| JP | 5-89353 | U | | 12/1993 |
| JP | 7-17640 | A | | 1/1995 |
| JP | 8-217260 | A | | 8/1996 |
| JP | 10-025030 | A | | 1/1998 |
| JP | 10025030 | A | * | 1/1998 |
| JP | 2004-123292 | A | | 4/2004 |
| JP | 2006-008316 | A | | 1/2006 |
| JP | 2006008316 | A | * | 1/2006 |

OTHER PUBLICATIONS

Office Action (Notification of Reasons of Rejection) dated May 2, 2012, issued in corresponding Japanese Patent Application No. 2010-113864, and an English Translation thereof. (5 pages).

* cited by examiner

*Primary Examiner* — Patrick Cicchino
(74) *Attorney, Agent, or Firm* — Buchanan Ingersoll & Rooney PC

(57) ABSTRACT

A paper sheet cassette includes a paper sheet containing part for loading and containing paper sheets, a pair of side edge positioning members provided so as to move toward or away from each other in a width direction of the paper sheets for determining a position of the paper sheets in their width direction, an interlock mechanism for synchronously moving the pair of side edge positioning members toward or away from each other, a latch member which is movable along with a first member of the pair of side edge positioning members and is provided with a lock tooth portion formed thereon, and a lock member which has a latch claw which can be brought into or out of engagement with the lock tooth portion and is movable along with a second member of the pair of side edge positioning members.

11 Claims, 3 Drawing Sheets

PAPER SHEET CASSETTE AND IMAGE FORMING DEVICE

CROSS-REFERENCE TO RELATED APPLICATION

This invention is based on Japanese patent application No. 2010-113864 filed in Japan on May 18, 2010, the entire content of which is hereby incorporated by reference.

BACKGROUND OF THE INVENTION

1. Field of the Invention

The present invention relates to a paper sheet cassette for disposing paper sheets in a stacked state relative to a paper sheet feed roller to feed the stacked paper sheets with the top sheet fed first by the paper sheet feed roller, and especially to a paper sheet cassette comprising a paper sheet containing part for loading and containing paper sheets, and a paper sheet positioning mechanism for determining the position of paper sheets contained in the paper sheet containing part in their width direction which is across the direction of feed of paper sheet by the paper sheet feed roller.

2. Description of Related Art

Paper sheet cassettes of this type and paper sheet feed mechanisms utilizing such paper sheet cassettes are used in various fields. For example, paper sheet cassettes are widely used in image forming devices which are capable of forming images on the paper sheets by feeding paper sheets from a group of paper sheets loaded and contained in a paper sheet cassette by a paper sheet feed roller through an image formation path passing through an image forming portion. Such image forming devices include copying machines, printers, facsimile machines, and multifunctional machines which are the combinations of two or more of these devices.

The reason that the mechanism for positioning paper sheets contained in the paper sheet containing part is employed in such a paper sheet cassette is as follows: Paper sheets are fed by a paper sheet feed roller formed to have a width normally shorter than the width of paper sheets in the direction which is across the direction of feed of paper sheets. In this paper sheet feeding, paper sheets may be skewed due to insufficient positioning of paper sheets. This may adversely affect the following transportation of paper sheets, generate wrinkles in paper sheets, generate noise by the contact between the paper sheets and components associated with transportation of paper sheets, and prevent desired processing on paper sheets. The use of the positioning mechanism is to suppress the generation of such problems by determining the position of the paper sheets so that paper sheets can be fed as straight as possible when fed by the paper sheet feed roller.

Moreover, such a paper sheet positioning mechanism employed sometimes includes a pair of paper sheet side edge positioning members for determining the positions of both side edges of the paper sheets in the width direction of the paper sheets, the pair of paper sheet side edge positioning members being provided on the paper sheet cassette body so as to move toward or away from each other so that the paper sheets can be easily positioned in a predetermined position relative to the paper sheet feed roller, and an interlock mechanism for synchronously moving these pair of paper sheet side edge positioning members toward or away from each other in the width direction of the paper sheets.

Known examples of such an interlock mechanism include those utilizing a rack pinion mechanism.

For example, Japanese Unexamined Patent Publication No. 7-17640 (JP7-17640A) describes a paper sheet positioning mechanism which determines the position of the side edges of paper sheets by moving a pair of paper sheet side edge positioning members toward or away from each other by an interlock mechanism using a'rack pinion mechanism. The publication also describes a mechanism which moves the paper sheets in alignment with a paper passage reference position along with the interlock mechanism in a state that the paper sheets are nipped between the pair of paper sheet side edge positioning members in the width direction of the paper sheets in such a manner.

The positions of the pair of paper sheet side edge positioning members can be easily adjusted according to the paper sheet positioning mechanism which determines the position of paper sheets by nipping the paper sheets in their width direction by adjusting the pair of paper sheet side edge positioning members to move toward or away from each other using the interlock mechanism. However, actually, due to the rattling between the members in the complicated interlock mechanism (for example, in a mechanism using a rack pinion mechanism, rattling caused by backlash in meshing of gears), the position of at least one of the pair of the paper sheet side edge positioning members may be shifted. For this and other reasons, the restriction of the position of the paper sheets by the positioning members may be insufficient and the position of the paper sheets may be shifted.

SUMMARY OF THE INVENTION

The present invention provides the following paper sheet cassette and image forming device:

(1) Paper Sheet Cassette

A paper sheet cassette for containing paper sheets which are loaded to be withdrawn with an uppermost paper sheet fed first in a predetermined direction, the paper sheet cassette comprising a paper sheet containing part for loading and containing the paper sheets, a pair of side edge positioning members provided so as to move toward or away from each other in a width direction of the paper sheets for determining a position of the paper sheets in their width direction across the direction of withdrawal of the paper sheets contained in the paper sheet containing part, an interlock mechanism for synchronously moving the pair of side edge positioning members toward or away from each other, a latch member which is movable along with a first side edge positioning member of the pair of side edge positioning members and is provided with a lock tooth portion formed thereon, and a lock member which has a latch claw which can be brought into or out of engagement with the lock tooth portion and is movable along with a second side edge positioning member of the pair of side edge positioning members, and wherein positions of the pair of side edge positioning members are fixed when the lock member brings the latch claw into engagement with the lock tooth portion of the latch member.

(2) Image Forming Device

An image forming device comprising a paper sheet cassette for loading paper sheets, a paper sheet feed roller for withdrawing an uppermost paper sheet of the paper sheets loaded in the paper sheet cassette from the paper sheet cassette, and an image forming portion for forming an image on the paper sheet withdrawn by the paper sheet feed roller, wherein the paper sheet cassette comprises:

a paper sheet containing part for loading and containing the paper sheets, a pair of side edge positioning members provided so as to move toward or away from each other in a width direction of the paper sheets for determining a position of the paper sheets in their width direction across the direction of withdrawal of the paper sheets contained in the paper sheet containing part by the paper sheet feed roller, an interlock mechanism for synchronously moving the pair of side edge positioning members toward or away from each other, a latch member which is movable along with a first side edge positioning member of the pair of side edge positioning members and is provided with a lock tooth portion formed thereon, and a lock member which has a latch claw which can be brought into or out of engagement with the lock tooth portion and is movable along with a second side edge positioning member of the pair of side edge positioning members, and wherein positions of the pair of side edge positioning members are fixed when the lock member brings the latch claw into engagement with the lock tooth portion of the latch member.

The foregoing and other objects, features, aspects and advantages of the present invention will become more apparent from the following detailed description of preferred embodiments of the present invention when taken in conjunction with accompanying drawings.

DESCRIPTION OF THE PREFERRED EMBODIMENTS

Figure 1:
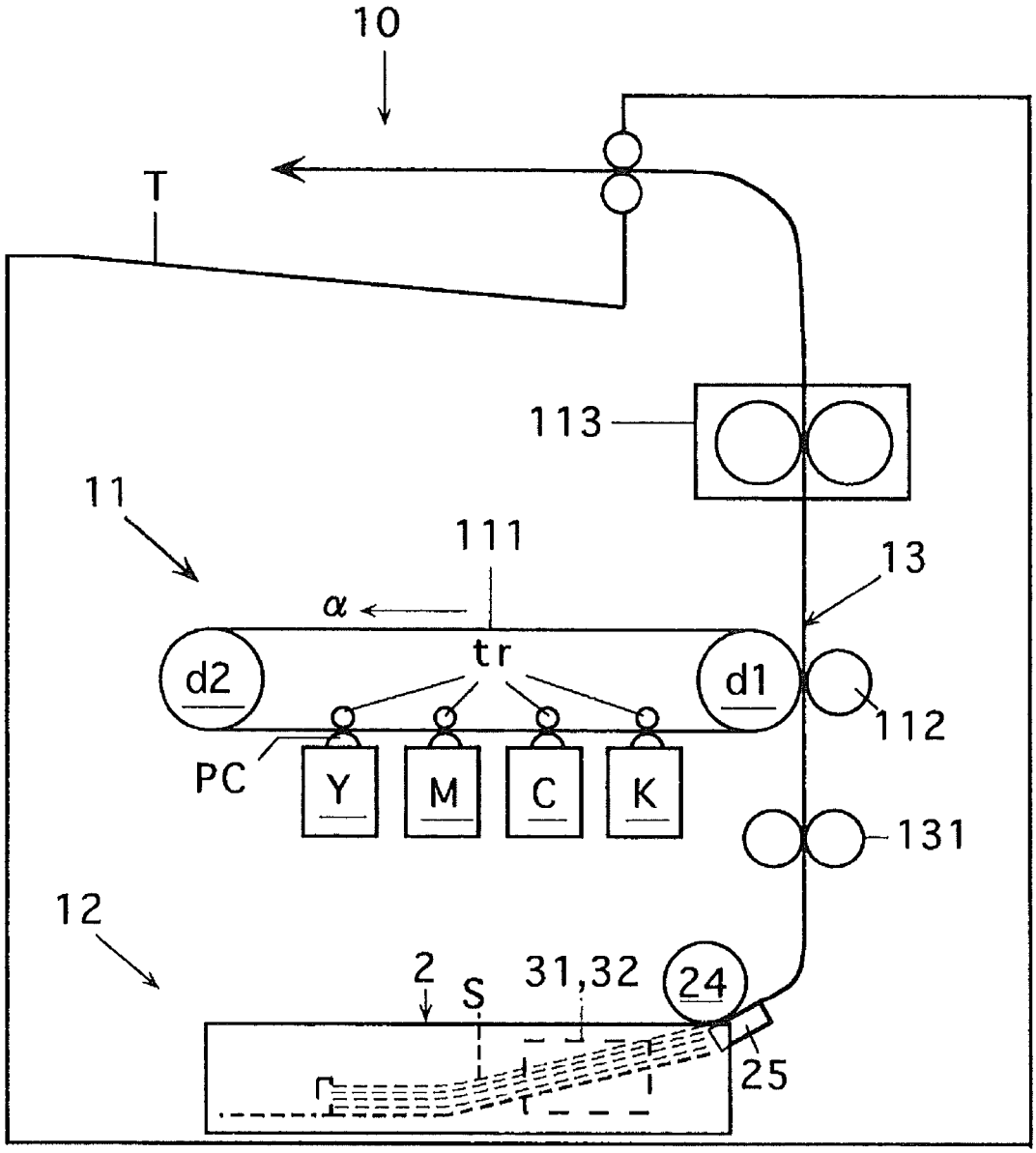
FIG. 1 shows a construction of an example of an image forming device.

FIG. 1 shows a tandem-type color printer as an example of the image forming device.

It should be noted that the image forming device according to the present invention is not limited to tandem-type color printers. The present invention can be also applied to so-called cycle-type (for example, four-cycle) color image forming devices and monochrome image forming devices, as well as to printers, copying machines, facsimile machines, and multifunctional machines which are combinations of two or more of these devices. Moreover, the present invention can be applied to image forming devices employing various image formation systems such as electrophotographic, electrostatic recording and ink-printing systems.

A printer 10 shown in FIG. 1 has an image forming portion 11, a paper sheet feed portion 12 below the image forming portion, and an image formation path 13. The image forming portion. 11 includes a driving roller d1, an opposing roller d2 and an intermediate transfer belt 111. The driving roller d1 is rotationally driven by a belt drive (not shown). The intermediate transfer belt 111 is wound on the rollers d1 and d2, and is capable of being rotationally driven in a counterclockwise direction $\alpha$ in the drawing. A yellow image formation unit Y, a magenta image formation unit M, a cyan image formation unit C and a black image formation unit K are disposed in the order stated along the belt 111 in the direction of travel of the belt.

The image formation unit associated with each color is capable of forming an electrostatic latent image corresponding to an image of the associated color on a photosensitive member PC by an electrophotography method based on image information sent from an image scanner (not shown) and image information transmitted from an external computer (not shown), external facsimile machine and other components, developing the latent image with a toner of the associated color to form a toner image, and primarily transferring this by a primary transfer roller tr to which a primary transfer bias is applied from a power source (not shown) on the belt 111.

In forming an image, any one of the four image formation units may be used to form a monochrome toner image, or two or more of the image formation units may be used to form a color image. When two or more image formation units are used, the color toner images formed in those image formation units are primarily transferred onto the belt 111 at the timing that they are layered on the belt 111.

The image forming portion 11 further includes a secondary transfer roller 112 opposing the belt. 111 downstream of the black image formation unit K in the direction of rotation of the intermediate transfer belt 111 and a fixing device 113 disposed thereabove.

The toner image or the layered toner images which are primarily transferred onto the belt 111 as described above are secondarily transferred onto a paper sheet S transferred along the image formation path 13 by the secondary transfer roller 112 to which a secondary transfer bias is applied from the power source (not shown).

A paper sheet on which an image is to be formed is fed from a paper sheet feed portion 12 described below. The paper sheet fed from the paper sheet feed portion 12 is thrusted against a resister roller unit 131 positioned at the inlet of the image formation path 13 to be paused, and is transferred to the image formation path 13 by the resister roller unit 131 at the timing that an image can be formed in a predetermined area of the paper sheet in the image forming portion 11.

The toner image which has been secondarily transferred onto the paper sheet in such a manner is fixed with heating under increased pressure by the fixing device 113, and the paper sheet having such a fixed toner image is discharged into a discharge tray T.

The paper sheet feed portion 12 will be further described.

The paper sheet feed portion 12 is a part where the paper sheet cassette 2 can be attached to and detached from. When the printer 10 is used, the paper sheet cassette 2 in which paper sheets are loaded and contained is detachably attached to this paper sheet feed portion 12.

Figure 2:
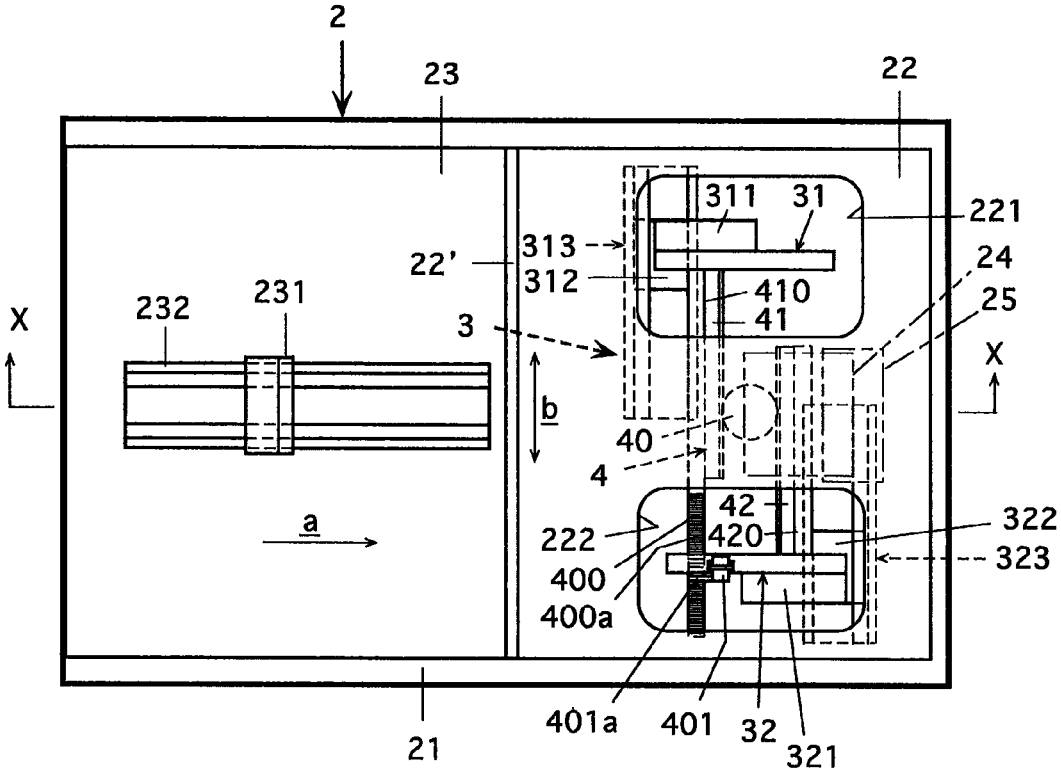
FIG. 2 is a plan view of an example of a paper sheet cassette.
Figure 3:
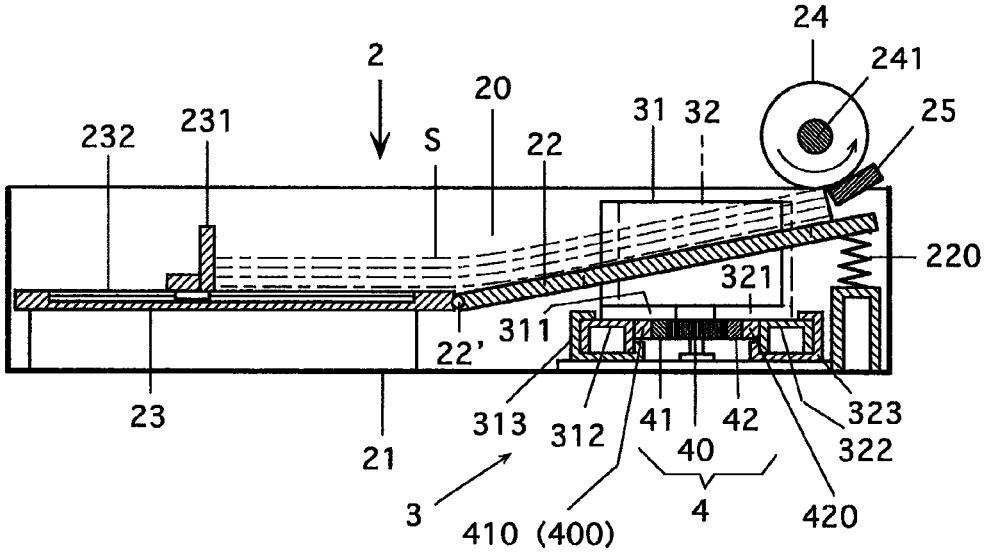
FIG. 3 is a cross-sectional view of the paper sheet cassette shown in FIG. 2 taken along line X-X.
Figure 4:
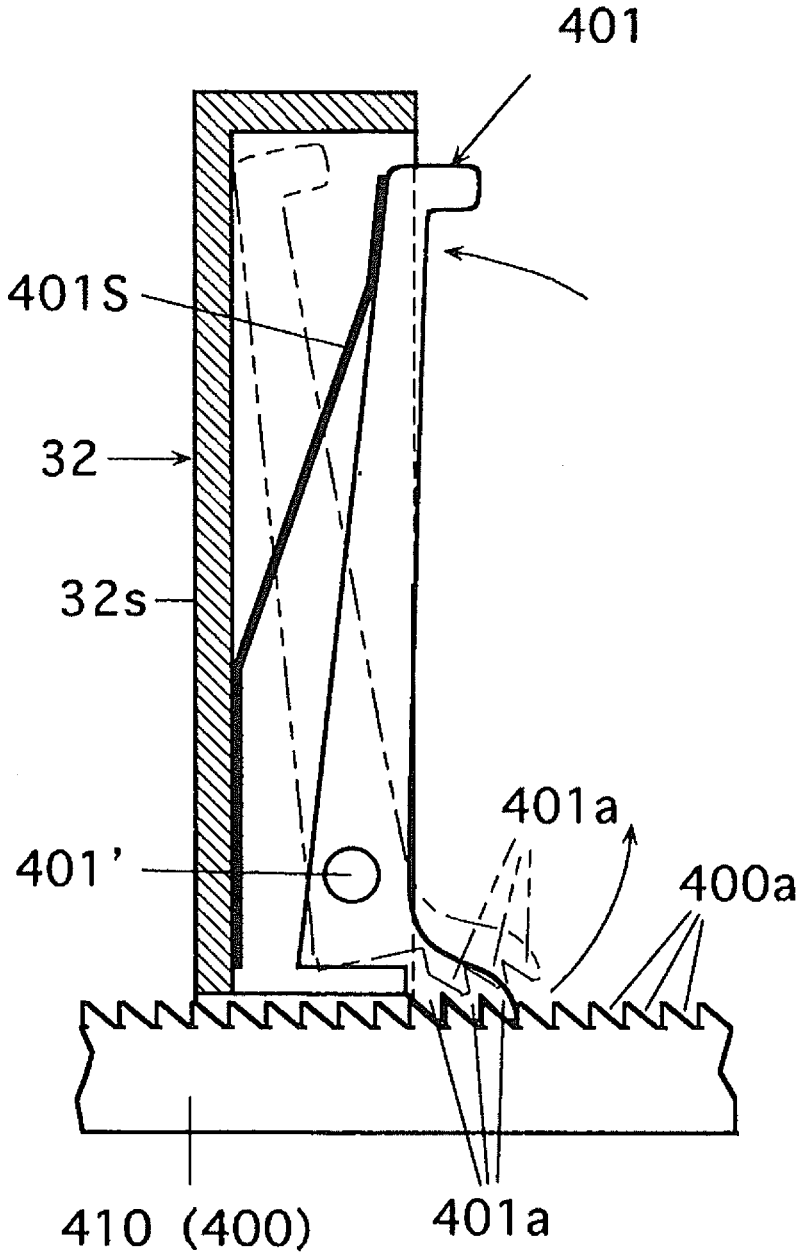
FIG. 4 shows a main part of a paper sheet positioning mechanism.

FIG. 2 is a plan view of the paper sheet cassette 2. FIG. 3 is a cross-sectional view of the paper sheet cassette 2 taken along line X-X. FIG. 4 shows a main part of the paper sheet positioning mechanism 3 which determines the position of paper sheets in the cassette in the width direction of paper sheets in the paper sheet cassette 2. FIG. 3 also shows a cross-section of a slider 322 for ease of understanding. The slider 322 is invisible in a normal state, on which a side edge positioning member 32 is mounted.

The paper sheet cassette 2 includes a paper sheet cassette body 21 which opens upwardly, and a front base plate 22 and a rear base plate 23 disposed in the paper sheet cassette body 21. The front base plate 22 is capable of pivoting about a rear end portion 22' to lift and lower its front end portion. A lifting force is applied to the front end portion of the front base plate 22 from below by a spring 220. An area above these front and rear base plates 22 and 23 serves as a paper sheet containing part 20. The paper sheet cassette 2 is further provided with a paper sheet feed roller 24 and a paper sheet handling pad 25 opposing the paper sheet feed roller 24 from below.

In this Example, the paper sheet feed roller 24 is rotatably supported by the paper sheet cassette body 21 via a roller supporting member (not shown), and the handling pad 25 is also supported in a fixed position of the paper sheet cassette body 21 via the pad supporting member (not shown).

The paper sheet feed roller 24 and handling pad 25 are positioned at the center of the cassette in the width direction b of paper sheet (cassette width direction) across the direction of feed of paper sheet by the paper sheet feed roller 24. This paper sheet cassette 2 employs a central paper sheet passage reference, that is, the passage of paper sheets based on their widthwise center.

According to this paper sheet cassette 2, the paper sheets S can be loaded, contained and positioned in the paper sheet cassette 2 in the following manner: The paper sheet cassette 2 is removed from the printer body. The front base plate 22 in the paper sheet cassette is pushed down against the spring 220. In that state, the paper sheets S with a size selected for image formation are loaded and contained in the paper sheet containing part 20 on the front base plate 22 and rear base plate 23. Furthermore, a paper sheet positioning mechanism 3 determines the position of those paper sheets S in the cassette in their width direction (cassette width direction) b. The paper sheet positioning mechanism 3 will be described later in detail. A member 231 determines the position of the rear ends of paper sheets S. The rear end positioning member 231 is provided on the rear base plate 23 and movable in the direction a of feed of paper sheets. The position of the rear end positioning member 231 is adjustable along a rail device 232 provided on the rear base plate 23.

The paper sheet cassette 2 in which the paper sheets S are loaded, contained and positioned in such a manner is inserted into and attached to the body of the printer 10 from the front side to the back side in FIG. 1. The front base plate 22 is then lifted by a spring 220, whereby the front end portion of the paper sheets S comes into contact with the paper feed roller 24 from below.

The paper sheet cassette 2 may be provided with a known type of stopper which stays pressed down when the front base plate 22 in the paper sheet cassette is pressed down against the spring 220.

When the paper cassette 2 is provided with such a stopper, the following construction may be employed: When the paper sheet cassette 2 is attached to the printer body, the stopper is unfasten by a known type of stopper canceller (not shown) provided on the printer body side, whereby the front base plate 22 is lifted by the spring 220, and the end (front end) portion of the paper sheet S comes into contact with the paper sheet feed roller 24 from below.

In this embodiment, when the paper sheet cassette 2 is attached to the printer body, a shaft 241 of the paper sheet feed roller 24 engages a transmission mechanism (not shown) provided on the printer body. The shaft 241 can be thus rotationally driven in the counterclockwise direction (paper sheet feed direction) in FIG. 3 by a motor (not shown) via the transmission mechanism.

Thus, the paper sheets S in the paper cassette 2 are withdrawn with the top sheet fed first at a predetermined timing for image formation by the rotation of the paper sheet feed roller 24. In this paper sheet feed, the paper sheets are handled by the paper sheet feed roller 24 and the handling pad 25, and fed to the resister roller unit 131 sheet by sheet.

In this embodiment, the paper sheet feed roller 24 and handling pad 25 are mounted on the paper sheet cassette 2, but one or both of them may be provided on the printer body. Moreover, a handling roller may be employed in place of the handling pad 25.

Next, the paper sheet positioning mechanism 3 for determining the position of paper sheets in their width direction will be described.

The paper sheet positioning mechanism 3 includes a pair of side edge positioning members 31, 32 and an interlock mechanism 4. The side edge positioning members 31, 32 are for determining the positions of the side edges of paper sheets S in their width direction b, and are provided on the paper sheet cassette body 21 so as to move toward or away from each other in the width direction of the paper sheets. The interlock mechanism 4 is for synchronously moving these side edge positioning members 31, 32 toward or away from each other in the width direction of the paper sheets.

The side edge positioning member 31 is upstanding on a base member 311, and passes through an opening 221 formed in the front base plate 22 to reach an upper portion of the front base plate 22. The base member 311 is fixed to the slider 312. The slider 312 is fitted with the rail member 313 provided at the bottom of a front end portion of the cassette body 21 in the direction a of feed of paper sheets slidably in the b direction.

The side edge positioning member 32 is upstanding on the base member 321, and passes through another opening 222 formed in the front base plate 22 to reach an upper portion of the front base plate 22. The base member 321 is fixedly mounted on the slider 322. The slider 322 is fitted with another rail member 323 provided at the bottom of a front end portion of the cassette body 21 in the direction a of feed of paper sheets slidably in the b direction.

The interlock mechanism 4 includes a pinion gear 40 rotatably supported by the paper cassette body 21 below the front base plate 22 and a pair of racks (rack gears) 41, 42 engaging this.

A rack support rod 410 is cantilevered from the base member 311 which supports one side edge positioning member 31 and extending in the b direction. One of the racks 41 is attached to this rod 410 to engage the pinion gear 40.

A rack support rod 420 is cantilevered from the base member 321 which supports the other side edge positioning member 32 and extending in the b direction. The other rack 42 is attached to this rod 420 to engage the pinion gear 40.

According to this interlock mechanism 4, moving at least one of the side edge positioning members 31, 32 in the b direction can move those side edge positioning members 31, 32 by the rack pinion mechanisms 40, 41, 42 toward or away from each other.

Therefore, prior to loading and containing the paper sheets S on the front base plate 22 and the rear base plate 23, the interval between the side edge positioning members 31, 32 are made wider than the width of paper sheets by using the interlock mechanism 4. In that state, the paper sheets S are loaded on the base plates 22, 23 and placed between those side edge positioning members 31, 32. The side edge positioning members 31, 32 are then moved toward each other by using the interlock mechanism 4 to be in contact with the side edges of the paper sheets S. The position of the paper sheets S in the width direction (cassette width direction) b can be thus determined, and the central position of the paper sheets S in their width direction can be determined relative to the paper sheet feed roller 24. Moreover, the position of the rear end portion of the paper sheets S may be determined by adjusting the position of the rear end positioning member 231. In such a manner, the paper sheets S can be easily positioned by using the interlock mechanism 4 and the rear end positioning member 231.

What is noteworthy about this paper sheet cassette 2 is that even if there is rattling in the interlock mechanism 4 due to the backlash of gears and other causes, the side edge positioning members 31, 32 in a state of determining the position of the paper sheets S can be stably fixed in that position mentioned above.

Accordingly, the paper sheet positioning mechanism 4 further includes a latch member 400 which is movable in the b direction along with one of the side edge positioning members 31 and as shown in FIG. 4, a lock member 401 which is movable along with the other side edge positioning member 32.

The rack support rod 410 is cantilevered by the base member 311 of the side edge positioning member 31 and is extending in the b direction. The rack support rod 410 also serves as the latch member 400. That is, the rack support rod 410 is extending over a long distance to serve also as the latch member 400. On the upper face of the portion of this rack support rod 410 (latch member 400) extending below the side edge positioning member 32 are formed a plurality of lock tooth portions 400*a* along the longitudinal direction.

As shown in FIG. 4, the lock member 401 is swingably supported on the back side (the side opposite to the paper sheet side edge positioning side 32S) of the other side edge positioning member 32 at a lower end portion of the lock member by a shaft 401'. A force is always applied to a head portion of the lock member in the direction away from the side edge positioning member 32 by a sheet plate spring 4015. A plurality of latch claws 401*a* are provided on the lock member 401 below the swing shaft 401'. The number of the latch claws 401*a* is, but is not limited to, plural in this example.

The lock member 401 is biased by the sheet plate spring 401S, whereby the latch claws 401*a* can engage the lock tooth portions 400*a* of the latch member 400.

Therefore, swinging the lock member 401 to the side edge positioning member 32 side against the sheet plate spring 401S disengages the latch claws 401*a* from the lock tooth portions 400*a* of the latch member 400. In this state, the side edge positioning members 31, 32 are moved to determine the position of the paper sheets S in a manner of nipping them from both sides. Furthermore, by bringing the latch claws 401*a* of the lock member 401 into engagement with the lock tooth portions 400*a* of the latch member 400, the side edge positioning members 31, 32 can be fixed stably and easily in a state of determining the position of the paper sheets S in that position and at the relative interval even if there is rattling in the interlock mechanism 4.

In such a manner, the position of the paper sheets S in the cassette 2 can be determined with a shift of the position of the paper sheets S sufficiently suppressed, and the paper sheets can be smoothly fed to the resister roller unit 131 by the paper sheet feed roller 24 in the desired posture of being restricted by the side edge positioning members 31, 32. Accordingly, images can be formed on the paper sheets smoothly and favorably.

As described above, the present invention provides a paper sheet cassette for disposing stacked paper sheets in a loaded state relative to a paper sheet feed roller to feed the paper sheets with the top sheet fed first by the paper sheet feed roller, the paper sheet cassette comprising a paper sheet containing part for loading and containing paper sheets, and a paper sheet positioning mechanism for determining the position of paper sheets contained in the paper sheet containing part in their width direction which is across the direction of feed of paper sheet by the paper sheet feed roller, the paper sheet positioning mechanism comprising a pair of paper sheet side edge positioning, members for determining the positions of both side edges of the paper sheets in the width direction of the paper sheets, which are on the paper sheet cassette body so as to move toward or away from each other, and an interlock mechanism for synchronously moving the pair of paper sheet side edge positioning members toward and away from each other, the paper sheet positioning mechanism further comprising:

a latch member which is movable along with one of the pair of paper sheet side edge positioning members and is provided with a lock tooth portion formed thereon, and a lock member which is movable along the other paper sheet side edge positioning member, having a latch claw, and is capable of bringing the latch claw into and out of engagement with the lock tooth portion of the latch member, the lock member being capable of bringing the latch claw into engagement with the lock tooth portion of the latch member in a state that the position of the paper sheets loaded and contained in the paper sheet containing part is determined by nipping the paper sheets with the pair of paper sheet side edge positioning members to fix the position of the pair of paper sheet side edge positioning members.

The present invention also provides an image forming device which is capable of forming an image on a paper sheet by feeding the paper sheet from a group of paper sheets loaded and contained in a paper sheet cassette by a paper sheet feed roller to pass the paper sheet through an image formation path passing through an image forming portion, and the paper sheet cassette employed being the paper cassette according to the present invention.

According to the paper sheet cassette of the present invention, the pair of paper sheet side edge positioning members of the paper sheet positioning mechanism are moved away from each other by using the interlock mechanism in advance and by disengaging the latch claw of the lock member from the lock tooth portion of the latch member as necessary, so that a plurality of paper sheets can be loaded and contained between the pair of paper sheet side edge positioning members of the paper sheet containing part.

The position of the thus loaded and contained paper sheets can be then easily determined by moving the pair of paper sheet side edge positioning members toward each other by using the interlock mechanism in a manner of nipping the paper sheets from both sides in their width direction. Furthermore, the latch claw of the lock member can be engaged with the lock tooth portion of the latch member so that the pair of paper sheet side edge positioning members are fixed to stay in the state of nipping and positioning the paper sheets.

Thus, the paper sheets are positioned in such a state that a positional shift is sufficiently suppressed, so that the paper sheets can be smoothly fed by the paper sheet feed roller in the desired posture of being restricted by the paper sheet side edge positioning members. Moreover, the image forming device employing the paper sheet cassette according to the present invention as the paper cassette can accordingly form an images on the paper sheets smoothly and favorably.

The latch member and lock member in the paper sheet cassette according to the present invention may be any components as long as they are capable of fixing those paper sheet side edge positioning members in those positions in a state that the pair of paper sheet side edge positioning members are positioning the paper sheets in a manner of nipping them as described above from both sides in the width direction of the paper sheets. An example of such a latch member is that supported by said one member of the pair of paper sheet side edge positioning members and extends toward the other member, and has a plurality of the lock tooth portions in the extending direction.

An example of the lock member is that supported by the other member of the pair of paper sheet side edge positioning members so that the latch claw can be brought into and out of engagement with the lock tooth portions of the latch member.

It should be noted that the paper sheet cassette according to the present invention can be used not only in the field of image forming devices, but also in various fields in which a paper sheet cassette for disposing paper sheets in a stacked state relative to a paper sheet feed roller to feed the paper sheets with the top sheet fed first by a paper sheet feed roller is required.

According to the present invention, it is possible to provide a paper sheet cassette for disposing paper sheets in a stacked state relative to a paper sheet feed roller to feed the paper sheets with the top sheet fed first by the paper sheet feed roller, the paper sheet cassette comprising a paper sheet containing part for loading and containing the paper sheets, and a paper sheet positioning mechanism for determining the position of paper sheets contained in the paper sheet containing part in their width direction which is across the direction of feed of paper sheet by the paper sheet feed roller, the paper sheet positioning mechanism comprising a pair of paper sheet side edge positioning members for determining the positions of both side edges of the paper sheets in their width direction, which are on the paper sheet cassette body so as to move toward or away from each other, and an interlock mechanism for synchronously moving the pair of paper sheet side edge positioning members toward or away from each other in the width direction of paper sheets. According to the paper sheet cassette, the position of the pair of paper sheet side edge positioning members can be easily fixed while their positions and relative interval for positioning the paper sheets is maintained, and the paper sheets can be smoothly fed by the paper sheet feed roller accordingly in the desired posture of being restricted by the paper sheet side edge positioning members.

According to the present invention, it is possible to provide an image forming device which is capable of forming an image on a paper sheet by feeding the paper sheet from a group of paper sheets loaded and contained in a paper sheet cassette by a paper sheet feed roller to pass the paper sheet through an image formation path passing through an image forming portion, and smoothly feeding the paper sheet from the paper sheet cassette by the paper sheet feed roller in the desired posture, and accordingly forming the image on the paper sheet smoothly and favorably.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A removable paper sheet cassette for containing paper sheets which are loaded to be withdrawn with an uppermost paper sheet fed first in a predetermined direction, the paper sheet cassette comprising a paper sheet containing part for loading and containing the paper sheets, a pair of side edge positioning members provided so as to move toward or away from each other in a width direction of the paper sheets for determining a position of the paper sheets in their width direction across the direction of withdrawal of the paper sheets contained in the paper sheet containing part, an interlock mechanism for synchronously moving the pair of side edge positioning members toward or away from each other, a latch member which is movable along with a first side edge positioning member of the pair of side edge positioning members and is provided with a lock tooth portion formed thereon which faces in a direction orthogonal to a horizontal plane within which the pair of side edge positioning members are moved, and a lock member which is connected to a second side edge positioning member of the pair of side edge positioning members via a swing shaft so that the lock member pivots about the swing shaft, the swing shaft having a pivot axis that extends in a direction parallel to the horizontal plane and the second side edge positioning member, and the lock member has a latch claw which can be brought into or out of engagement with the lock tooth portion and is movable along with the second side edge positioning member, and wherein positions of the pair of side edge positioning members are fixed when the lock member brings the latch claw into engagement with the lock tooth portion of the latch member.

2. The paper cassette according to claim 1, wherein the latch member is supported by the first side edge positioning member and has such a shape that extends toward the second side edge positioning member and has a plurality of the lock tooth portions in the extending direction, and the lock member is supported by the second side edge positioning member so that the latch claw can be brought into or out of engagement with the lock tooth portions of the latch member.

3. The paper sheet cassette according to claim 1, wherein the lock member is provided on a side of the second side edge positioning member opposite to a side which comes into contact with the loaded paper sheets.

4. The paper sheet cassette according to claim 1, wherein the lock member is biased in such a direction that the latch claw engages the lock tooth portions.

5. An image forming device comprising a removable paper sheet cassette for loading paper sheets, a paper sheet feed roller for withdrawing an uppermost paper sheet of the paper sheets loaded in the paper sheet cassette from the paper sheet cassette, and an image forming portion for forming an image on the paper sheet withdrawn by the paper sheet feed roller, wherein the paper sheet cassette comprises:

a paper sheet containing part for loading and containing the paper sheets, a pair of side edge positioning members provided so as to move toward or away from each other in a width direction of the paper sheets for determining a position of the paper sheets in their width direction across the direction of withdrawal of the paper sheets contained in the paper sheet containing part by the paper sheet feed roller, an interlock mechanism for synchronously moving the pair of side edge positioning members toward or away from each other, a latch member which is movable along with a first side edge positioning member of the pair of side edge positioning members and is provided with a lock tooth portion formed thereon which faces in a direction orthogonal to a horizontal plane within which the pair of side edge positioning members are moved, and a lock member which is connected to a second side edge positioning member of the pair of side edge positioning members via a swing shaft so that the lock member pivots about the swing shaft, the swing shaft having a pivot axis that extends in a direction parallel to the horizontal plane and the second side edge positioning member, and the lock member has a latch claw which can be brought into or out of engagement with the lock tooth portion and is movable along with the second side edge positioning member, and wherein positions of the pair of side edge positioning members are fixed when the lock member brings the latch claw into engagement with the lock tooth portion of the latch member.

6. The image forming device according to claim 5, wherein the latch member is supported by the first side edge positioning member and has such a shape that extends toward the second side edge positioning member, has a plurality of the lock tooth portions in the extending direction, and the lock member is supported by the second side edge positioning member so that the latch claw can be brought into or out of engagement with the lock tooth portions of the latch member.

7. The image forming device according to claim 5, wherein the lock member is provided on a side of the second side edge positioning member opposite to a side which comes into contact with the loaded paper sheets.

8. The image forming device according to claim 5, wherein the lock member is biased in such a direction that the latch claw engages the lock tooth portions.

9. The image forming device according to claim 5, wherein the pair of side edge positioning members determine the position of the paper sheets so that the paper sheet feed roller is positioned at the widthwise center of the paper sheets.

10. The paper sheet cassette according to claim 1, wherein the lock member is biased to pivot about the swing shaft via a spring.

11. The image forming device according to claim 5, wherein the lock member is biased to pivot about the swing shaft via a spring.

* * * * *